US005524697A

United States Patent [19]

Cook

[11] Patent Number: 5,524,697

[45] **Date of Patent: * Jun. 11, 1996**

[54] METHOD AND APPARATUS FOR SINGLE DIE COMPOSITE PRODUCTION

[75] Inventor: Arnold J. Cook, Mt. Pleasant, Pa.

[73] Assignee: PCC Composites, Inc., Pittsburgh, Pa.

[ * ] Notice: The portion of the term of this patent subsequent to Feb. 2, 2010, has been disclaimed.

[21] Appl. No.: 12,058

[22] Filed: Feb. 1, 1993

Related U.S. Application Data

[63] Continuation-in-part of Ser. No. 493,933, Mar. 15, 1990, Pat. No. 5,183,096.

[51] Int. Cl.[6] ..... B22D 19/14

[52] U.S. Cl. ..... 164/97; 164/98; 164/35

[58] Field of Search ..... 164/35, 97, 98, 164/94, 95

[56] References Cited

U.S. PATENT DOCUMENTS

| | | | |
|---|---|---|---|
| 4,318,874 | 3/1982 | Lemelson | 264/40.1 |
| 4,340,109 | 7/1982 | Roddy | 164/97 |
| 4,548,253 | 10/1985 | Funatani | 164/97 |
| 5,183,096 | 2/1993 | Cook | 164/98 |
| 5,318,094 | 7/1994 | Joy et al. | 164/98 |

*Primary Examiner* P. Austin Bradley
*Assistant Examiner* James Miner
*Attorney, Agent, or Firm* Ansel M. Schwartz

[57] ABSTRACT

A method for producing composite materials by forming one material in a die cavity such that another material can be forced into the same die cavity and infiltrate the spaces in the first material. A method for producing a composite comprising the steps of injecting reinforcement material in a binder or suspension into a die cavity; burning off or removing the binder or suspension such that the reinforcement material remains in the die cavity; injecting liquid metal into the same die cavity such that it infiltrates the reinforcement material; solidifying the liquid metal; and removing the metal infiltrated composite material from the die cavity. An apparatus comprised of a die and a die cavity disposed inside the die. The apparatus is also comprised of a first port extending from the die cavity to the surface of the die through which reinforcement material in a binder is injected into a die cavity. Additionally, the apparatus is comprised of a second port extending from the die cavity to the surface of the die through which liquid metal is injected into the same die cavity.

28 Claims, 13 Drawing Sheets

METHOD AND APPARATUS FOR SINGLE DIE COMPOSITE PRODUCTION

This is a continuation-in-part of application(s) Ser. No. 07/493,933 filed on Mar. 15, 1990 now U.S. Pat. No. 5,183,096.

FIELD OF THE INVENTION

The present invention is related to dies and the production of composites. More specifically, the present invention relates to a method of molding parts in a die that are composed of one or more materials by injection of a discontinuous reinforcement and a metal.

BACKGROUND OF THE INVENTION

Dies are used for the production of a wide range of structures. Typically, when metal matrix composite components are formed, the cavity in the die is loaded by first placing a preheated preform of reinforcing material into the cavity, closing the die and subsequently injecting liquid metal into the cavity and the preform. There are many problems associated with this process—preforms cool while being loaded into the mold and the preform material oxidizes during the transfer from a furnace to the mold, preforms are normally fragile and often break during the loading into the die cavity, and the process requires additional time and equipment to produce the preforms, preheat the preforms, and carefully load the preforms into the die cavity. It would be desirable in order to save time, reduce production problems, and reduce cost to have a method to simplify and control the process variables for the production of metal matrix composites.

The present invention provides for the production of a discontinuously reinforced preform and its injection with metal to produce a metal matrix composite component in the same die cavity. It has a plurality of ports and controls the filling of the cavity, the density of the filling, and the degassing and debindering of material in the cavity.

SUMMARY OF THE INVENTION

The present invention pertains to a method for producing a composite. The method comprises the steps of filling a die cavity with reinforcement material mixed with a binder such that the reinforcement material remains in the die cavity; removing the binder such that the reinforcement material remains in the die cavity; forcing liquid metal into the same die cavity such that it infiltrates into the interstices about the reinforcement material; solidifying the liquid metal; and removing the metal infiltrated composite material from the die cavity.

The present invention also pertains to a method which can be used to produce ceramic and polymer matrix composites in addition to metal matrix composites. The method can be used with existing composite production systems. For example, it can be used with pressure die casting, squeeze casting, and investment casting.

A single die cavity is used to form a composite part by forcing a second phase material into the same die cavity after the first phase material (normally reinforcement material) is forced into the cavity. The first phase material is infiltrated by the second phase material resulting in a composite material. Normally the first phase material is a reinforcement material however other material could be used in either phase to provide properties other than strength such as wear, mechanical, or thermal properties, electrical properties, etc.

The standard method for producing a composite component are done in two ways. Reinforcement material is normally mixed with a binder (this is not always required) then the material is either injected into a preform die or is pressed into a preform die; the resulting preform is then removed from the preform die. The binder may be removed or left in the resulting preform. After the reinforcement has been molded into a preform and the preform has been removed from the preform die, it is normally heated in a furnace and then placed into a different mold, metal is then forced into the preform to form a composite.

The present invention removes the need for two separate dies (a preform die and a die to mold the composite in) and the problems associated with moving the preform from one die to the other. Some of these problems exist because of the brittle nature of many of the reinforcement materials (many of which are ceramic such as alumina, silicon carbide, etc.) and of preforms made of these materials. Other problems exist because of oxidation which occurs when the preform is moved from the preform die to the furnace and then to the die for molding the composite. Oxides can prevent the preform from being infiltrated properly.

The other method currently being used to make composite parts mixes both phases together before forcing them into a die. This is currently being done for low volume fractions, 10-20% of silicon carbide in aluminum. The liquid aluminum must be stirred to keep the SiC particles from settling out of the aluminum. The aluminum containing SiC is then forced into a die to form a composite part. The problem with this method is that it is limited to low volume fractions of reinforcement and reinforcements that will not react to the material it is mixed with.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
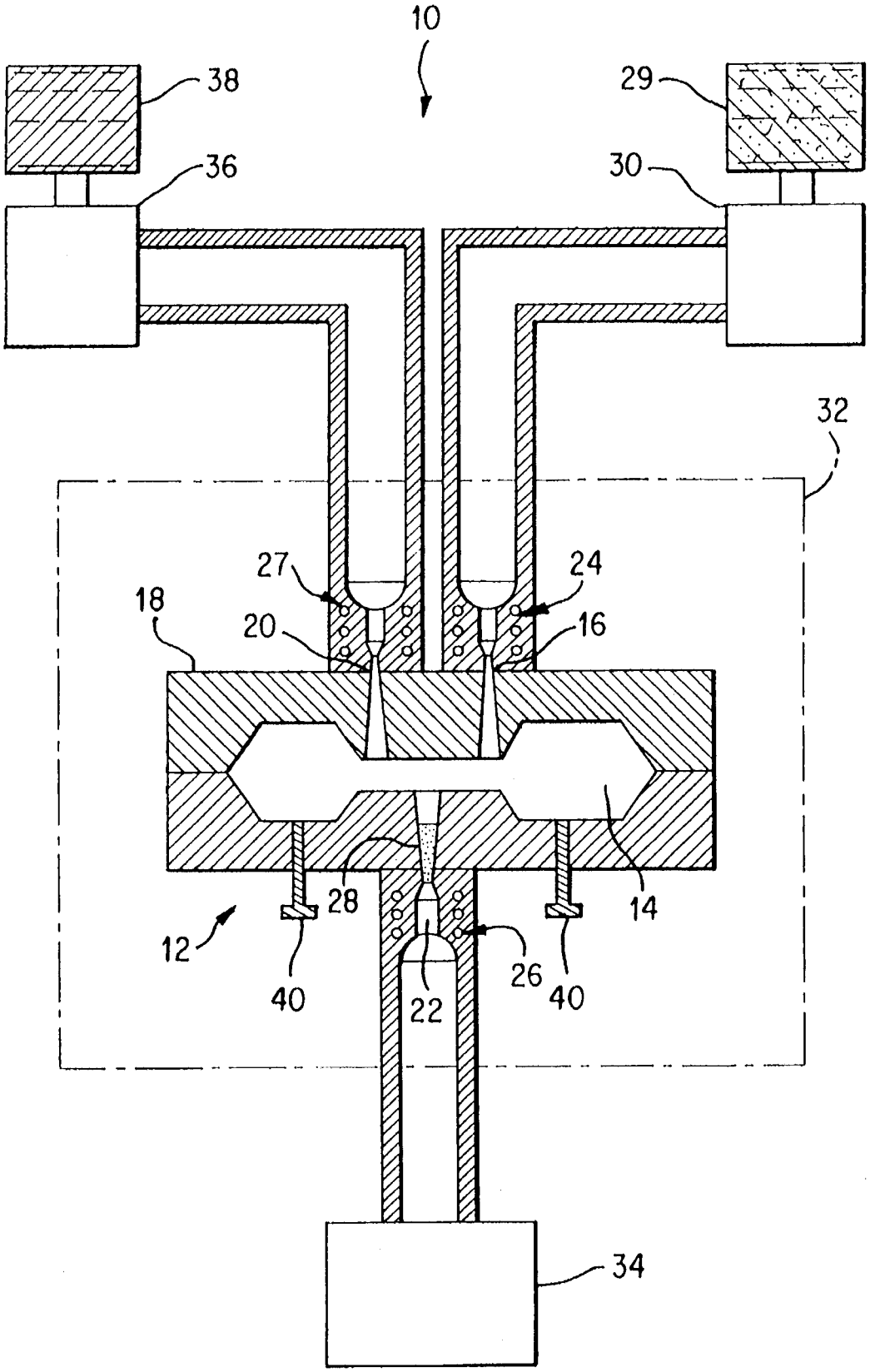
FIG. 1 is a schematic representation of a die.

Referring now to the drawings wherein like reference numerals refers to similar or identical parts throughout the several views, and more specifically to FIG. 1 thereof, there is shown a system 10 that can be used for producing composite material therein by batch or continuous operation. The system 10 is comprised of a die 12 and a die cavity 14 disposed in the die 12. The system 10 is also comprised of a first port 16 extending from the die cavity 14 to the surface 18 of the die 12 through which reinforcement material in a binder is injected into the die cavity 14. The system 10 is also comprised of a second port 20 extending from the die cavity 14 to the surface 18 of the die 12 through which liquid metal is injected into the die cavity 14. The system 10 can also include a third port 22 extending from the die cavity 14 to the surface 18 of the die 12 through which gas or fluid can exit the die cavity 14.

Preferably, the system 10 includes first a means 24 for controlling the temperature of the first port 16 and second means 27 for controlling the temperature of the second port 20. The temperature control means 24 is in thermal communication with the first port and can be, for instance, a jacket of water (not shown) and/or a heating coil (not shown) positioned about the first port 16. The temperature control means 27 is in thermal communication with the second port 20 in an identical manner to the first port 16.

There can also be a second means 26 for chilling the third port 22. The second chilling means 26 is in thermal communication with the third port 22 and is, for instance, a jacket of water (not shown) positioned about the third port 22. Additionally, the system 10 can include a filter 28 (as shown in FIG. 1) disposed in the third port 22 to allow gas to pass therethrough but not reinforcement material.

Figure 2:
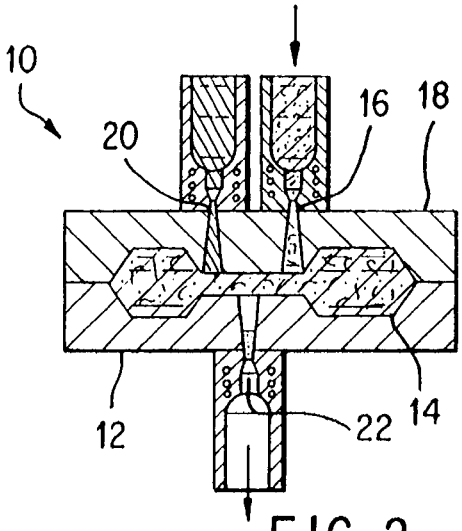
FIG. 2 is a schematic representation of the die being filled with reinforcement.
Figure 6:
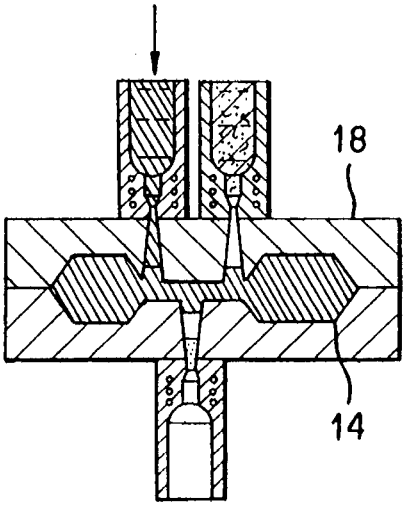
FIG. 6 is a schematic representation of the die with the liquid metal solidified in the die cavity.
Figure 7:
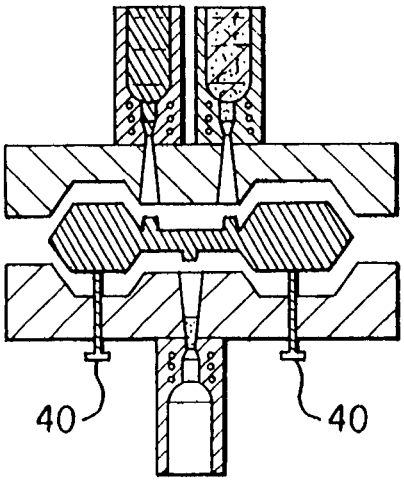
FIG. 7 is a schematic representation of the die being separated to obtain the solidified composite material in the shape of the die cavity.

In this embodiment, a die cast composite component is produced in a single die 12 by a method comprising the steps of: forcing reinforcement material mixed in a binder into the die cavity 14 (see FIG. 2); removing the binder such that the reinforcement material remains in the die cavity 14 (see FIG. 3); forcing liquid metal into the die cavity 14 such that it infiltrates into the interstices of the reinforcement material (see FIGS. 4 and 5); solidifying the liquid metal (see FIG. 6); and removing metal infiltrated composite material from the die cavity 14 (see FIG. 7).

Figure 4:
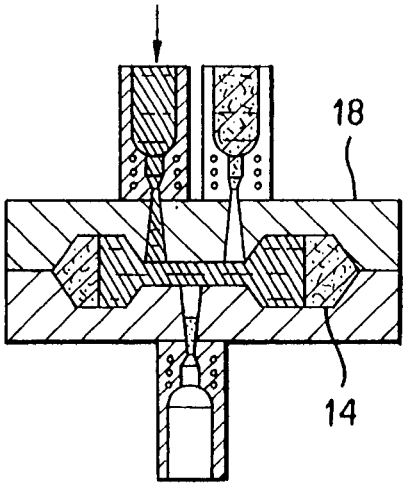
FIG. 4 is a schematic representation of the die with liquid metal injected at low pressure into the die cavity.
Figure 5:
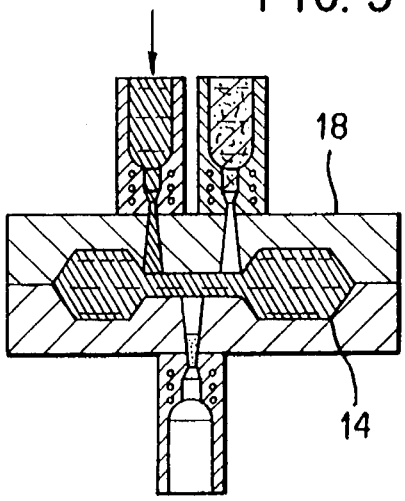
FIG. 5 is a schematic representation of a the die with liquid metal injected into the cavity under increased pressure.

Preferably, the injecting liquid metal step includes the steps of injecting liquid metal into the die cavity 14 at low pressure (see FIG. 4), and increasing the pressure such that the liquid metal infiltrates the reinforcement material (see FIG. 5). The binder may be removed by changing the temperature of the reinforcement containing the binder such the binder is burned off, and an additional step can be added to evacuate the die cavity 14 to eliminate gas pockets in the reinforcement material. Some binders may be removed by vacuum and without a change in temperature. The vacuum can be pulled through the parting between the die halves or out port 22. With a vacuum on the reinforcement, liquid metal does not trap gas in the reinforcement as it penetrates therethrough.

In the operation of the preferred embodiment, a reinforcement material of silicon carbide particles is mixed with a binder such that the resulting mixture is 10 to 85 percent silicon carbide. The binder can be inorganic (such as silica) or organic such as water or paraffin and in this example, a wax binder will be described. The silicon carbide particles are mixed with the wax as individual particles rather than as one solid piece in order to afford fluidity to the wax-particle mixture.

The silicon carbide particles mixed with wax are injected under a pressure of 100–2000 psi pressure, depending on the complexity of the mold and the amount of silicon carbide in the mixture, through the first port 16, as shown in FIG. 1. The silicon carbide particles mixed in the wax are placed under pressure by way of a piston or gas pressure chamber 30 fluidically connected to the first port 16 and to a first supply 29 of silicon carbide wax mixture. The silicon carbide particles mixed in wax pass through the first port 16 into the die cavity 14. This is continued until the die cavity 14 of the die 12 is filled with silicon carbide particles with the mixture at a temperature above the melting point of the wax binder but below the vapor point. Approximately 100° C. to 170° C. can be used with many wax binders.

The silicon carbide and wax mixture is prevented from exiting the die cavity 14 through port 20 by solidified metal in the port or a valve in the liquid metal line (not shown) and blocked by the filter that is sized to prevent mixture from exiting through port 22. The die cavity may be pre-evacuated through port 22 or through the parting between the die parts to assist filling the die cavity 14 with some binder materials.

Figure 3:
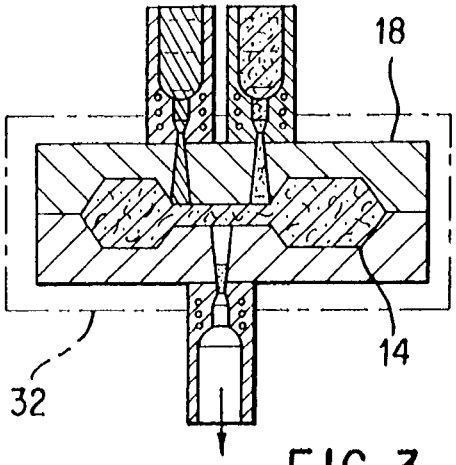
FIG. 3 is a schematic representation of the die with only reinforcement material in its chamber with binder being removed.

At this point, further injection of the mixture is halted and sufficient heat, such as 300°–600° centigrade is provided to the die cavity 14 from heating means 32 causing the wax to vaporize or burn away from the silicon carbide particles as shown in FIG. 3. Evacuation pump 34 (FIG. 1) evacuates the die cavity 14 before, during and after the silicon carbide and wax mixture is injected into the die cavity 14 through first port 16. Gas or fumes that result from the heating of the binder are removed through the third port 22 which has the evacuation pump connected to it. It should be noted that the die 12 may be kept at a temperature above the vapor point of the binder (300°–600° C.), so long as the silicon carbide and wax mixture are injected quickly into the die cavity 14. This helps to reduce the cycle time by removing the need to change the die 12 temperature.

After the wax is burned off and essentially all that remains in the die cavity 14 is the silicon carbide particles, liquid metal is injected through the second port 20 into the die cavity 14. In this example, the liquid aluminum is injected under pressure into the die cavity 14 by a piston or pressure chamber 36 fluidically connected with the second port and also fluidically connected to a second supply 38. The liquid aluminum fills the die cavity 14 and penetrates into the interstices between the silicon carbide particles as shown in FIGS. 4 and 5.

A first temperature control means 24 positioned about the first port 16, such as a water jacket, keeps the first port 15 and the area entering into the port at a lower temperature, normally below 200° C., causing any liquid aluminum that passes into the first port 16 to solidify and form a plug which prevents liquid aluminum from flowing out of the die cavity 14 via the first port 16. Similarly, a third temperature control means 26, such as a third water jacket causes any liquid aluminum passing into the third port 22 from the die cavity 14 to solidify and form a plug. The first temperature control means 24 and the third temperature control means 26 can also serve as an initiation point for solidification. The entrances of all the ports into the die cavity 14 are tapered to allow the any that solidifies in the port to come out easily when the final casting is removed.

The liquid metal is first injected into the die cavity 14 at a low pressure to allow for the solidification plugs to form in the first port 16 and third port 22 as shown in FIG. 4. The liquid metal injection pressure is then increased until the liquid aluminum infiltrates into the interstices of the silicon carbide particles as shown in FIG. 5. Temperature of the metal being injected can be controlled by temperature control means 27 in port 20. The die 12 is normally kept slightly below the melting point of the aluminum.

After the metal is injected, the pressure is maintained as the liquid metal is allowed to solidify as shown in FIG. 6 to fill the shrinkage with additional metal from port 20. Temperature control means 27 may be used to keep metal flowing into the die cavity 14 as the metal solidifies. After the liquid metal is solidified, the die is opened and the metal infiltrated silicon carbide particle component in the shape of the die cavity 14 is removed. Extraction pins 40 may be used to separate the die and remove the aluminum infiltrated silicon carbide reinforced component from the die 12 as shown in FIG. 7.

Figure 11:
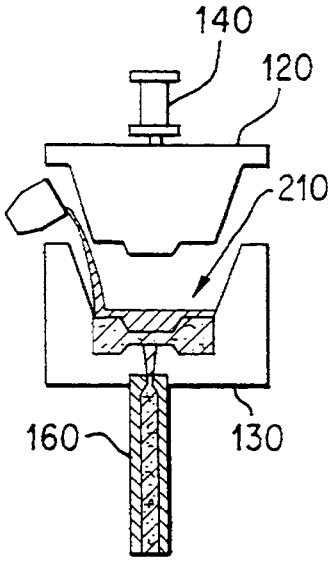
FIG. 11 is a schematic representation of metal being poured on top of reinforcement.
Figure 10:
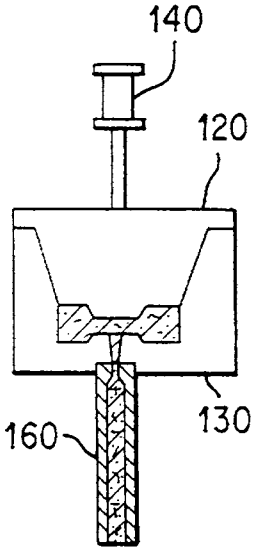
FIG. 10 is a schematic representation of binder being removed from reinforcement.
Figure 9:
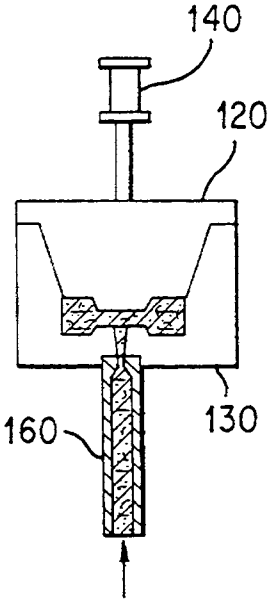
FIG. 9 is a schematic representation of injection of reinforcement material.
Figure 8:
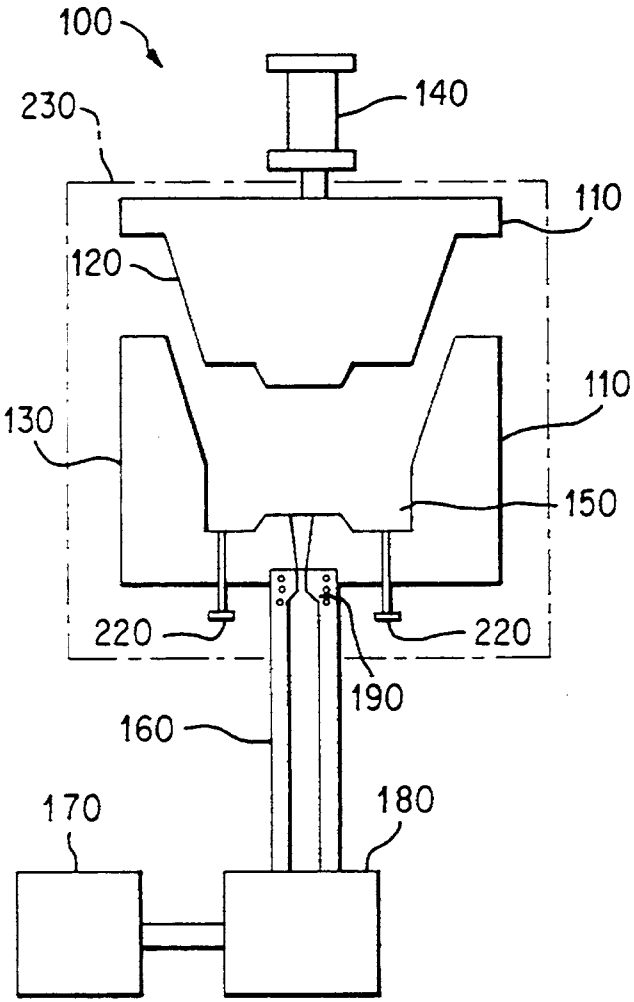
FIG. 8 is a schematic representation of another embodiment for squeeze casting.
Figure 15:
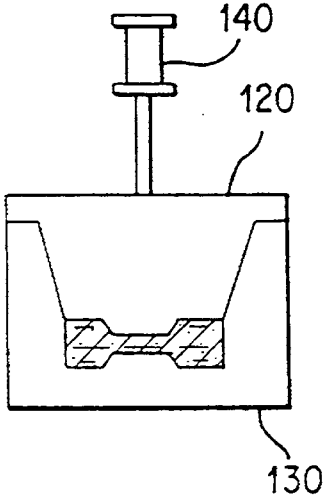
FIG. 15 is a schematic representation of reinforcement material being pressed into the shape of the die to make a preform.
Figure 13:
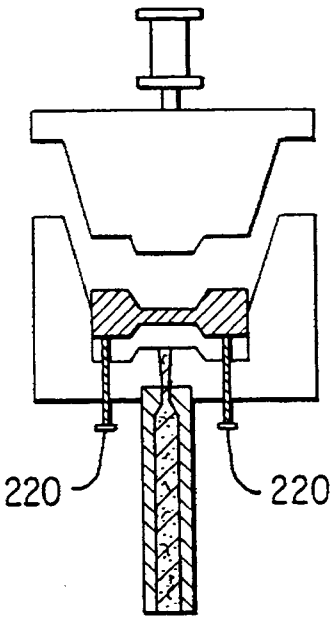
FIG. 13 is a schematic representation of composite part being ejected from die cavity.
Figure 12:
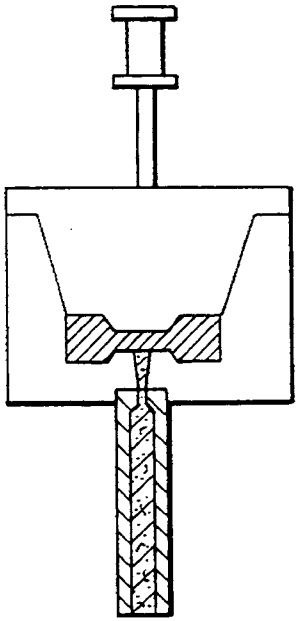
FIG. 12 is a schematic representation of metal being squeezed by the movable die half to fill die cavity and infiltrate reinforcement.

Alternatively, a system 100, as shown in FIG. 8, can be comprised of a die 110, and a die cavity 150. The upper die 120 is connected to a ram 140 which can move the upper die 120 up and down. The lower die 130 is in fluidic connection with port 160. The lower die 130 also has ejector pins 220. Port 160 is connected to a piston or pressure chamber 180 and a supply of reinforcement mixed with a binder 170. A heater 230 controls the die 110 temperature. The same silicon carbide mixed with a wax binder may be used. The ram 140 pushes the upper die 120 together with the bottom die 130. The die cavity 150 is then injected with silicon carbide and wax mixture through port 160, as shown in FIG. 9. The mixture is injected quickly with 100 to 2000 psi. The die 110 is kept at a temperature slightly below the melting point of the metal or material to be injected into the reinforcement, 300° to 600° C. normally for aluminum. In FIG. 10, the binder is being removed; wax binders burn off and gas can escape through the parting between the mold. A vacuum around the dies 120 and 130 (not shown) or another port connected to a vacuum (not shown) can assist in removing trapped gas. After the reinforcement (silicon carbide particles in this example) are debindered, the upper die 120 is raised with the ram 140 and liquid aluminum is poured on top of the preform (the name for the debindered shape of the reinforcement) as shown in FIG. 11. In FIG. 12, the ram 140 pushes the upper die down, squeezing the liquid aluminum into the preform and the die cavity 150. Liquid metal is prevented from entering into the port 160 because the temperature control means 190, which could contain a water jacket (not shown), causes the metal to solidify and form a plug. Alternatively, a valve (not shown) may be used to stop liquid metal from entering into port 160. After the part has solidified, the upper die 120 is raised by the ram 140 and the ejector pins 220 push out the metal infiltrated silicon carbide composite component with the shape of the die cavity 150, as shown in FIG. 13.

Figure 14:
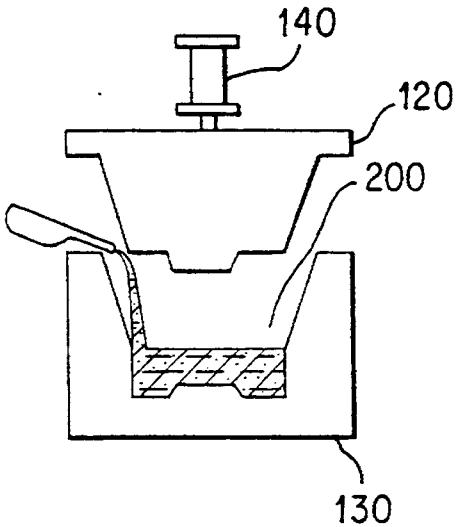
FIG. 14 is a schematic representation of reinforcement material being poured into a die.

It is also possible to pour or inject a silicon carbide particle and wax mixture, with or without a binder, into the bottom die 130 with the upper die 120 lifted as shown in FIG. 14 and then press the mixture into the die cavity 150 with the upper die 120 by lowering the ram 140. The rest of the steps would then follow those described in FIGS. 10 through 13.

Figure 16:
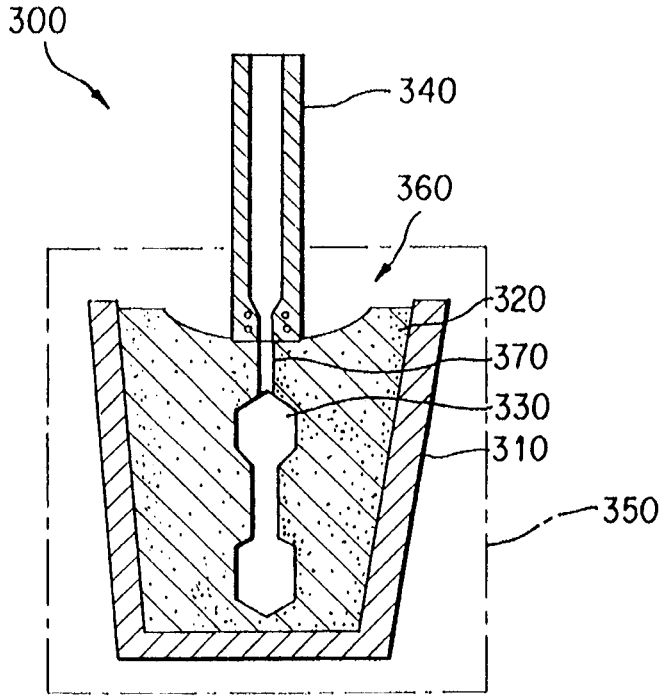
FIG. 16 is a schematic representation of an investment casting system.
Figure 17:
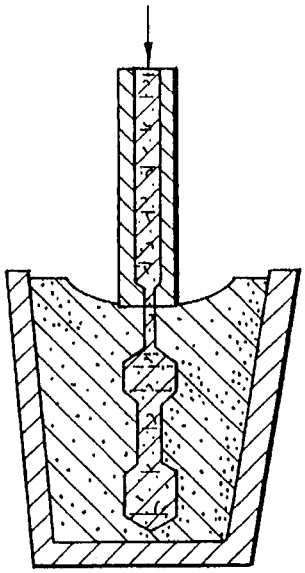
FIG. 17 is a schematic representation of reinforcement being injected into die cavity.
Figure 18:
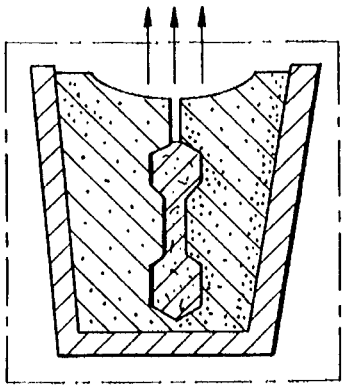
FIG. 18 is a schematic representation of binder being removed from reinforcement.
Figure 19:
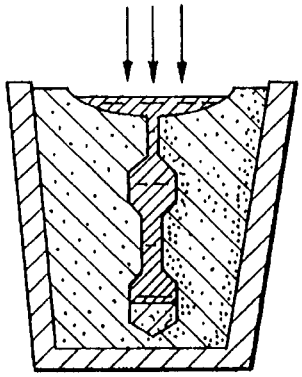
FIG. 19 is a schematic representation of metal being forced into die cavity and reinforcement.

A second alternative, a system 300, as shown in FIG. 16, comprised of an investment die 360 with heating means 350. Investment material 320 is cast with a die cavity 330 in the shape of the desired part by standard investment casting techniques. An injector 340 is then fluidically connected to the investment die 360 and silicon carbide particles and wax mixture are injected into the die cavity 350, as shown in FIG. 17. The investment material can be kept above the vapor point of the binder and slightly below the melting point of the metal to be used, for example 300°–600° C. for aluminum. After injecting, the injector 340 is removed and binder is burned off. Gas may escape through the spru system 370 or through the semi porous walls of the investment material. A vacuum (not shown) may be used to assist the removal of gas from the die cavity 350 and the investment material 320 as shown in FIG. 18. Once all the binder is removed, liquid metal can then be forced into the mold by gas pressurization or other investment casting techniques such as centrifugal casting as shown in FIG. 19.

Figure 20A:
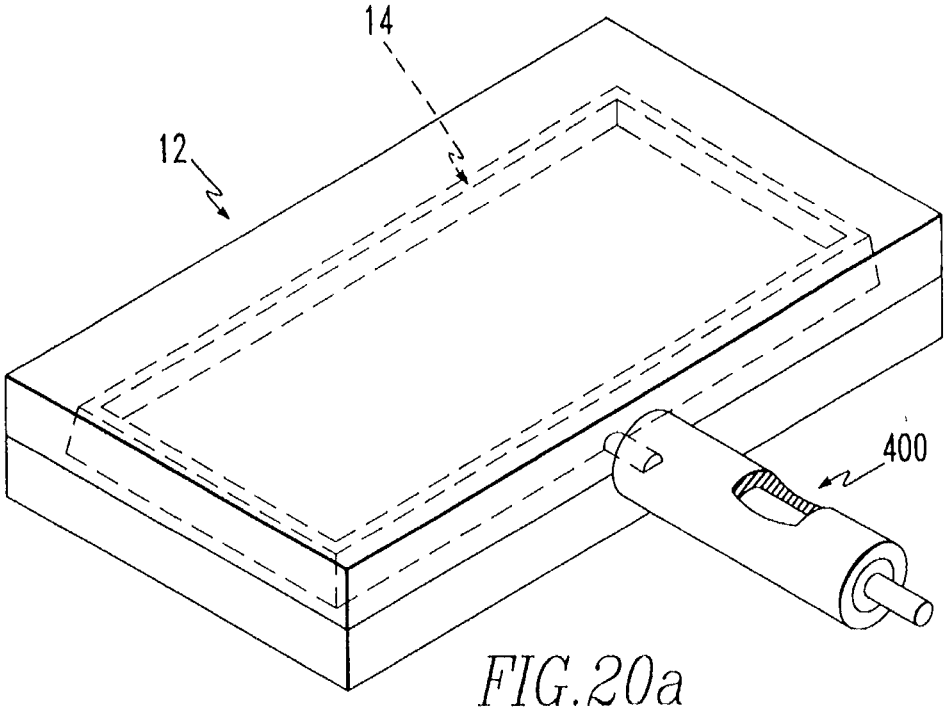
FIGS. 20*a*–20*g* are schematic representations showing a mold being infiltrated with reinforcement through a single injection nozzle and subsequent introduction of liquid metal through the single injection nozzle.
Figure 20B:
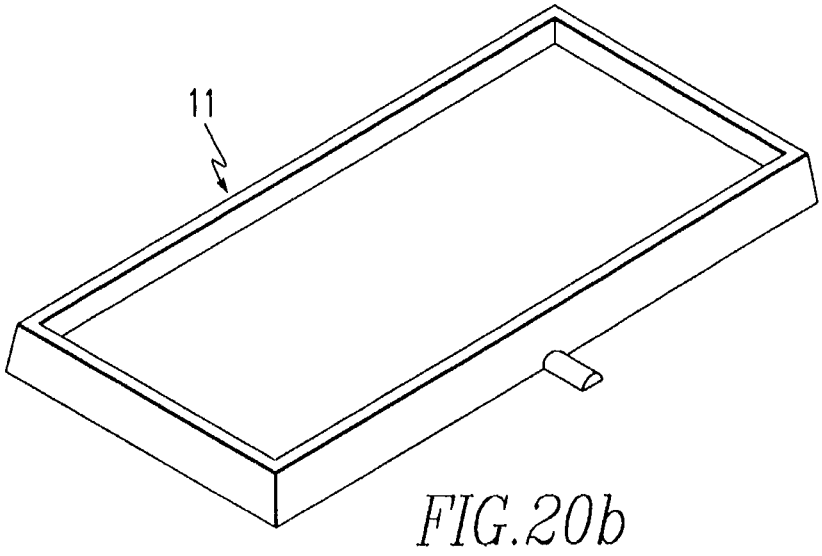
Figure 20C:
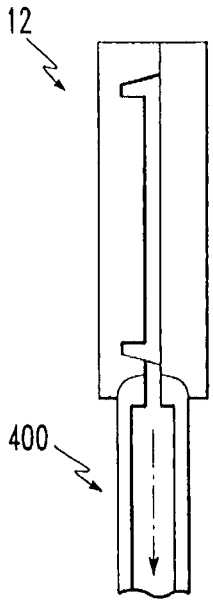
Figure 20D:
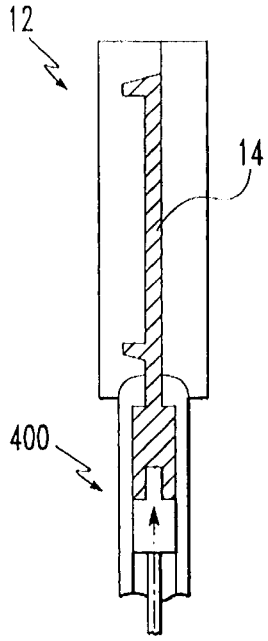
Figure 20E:
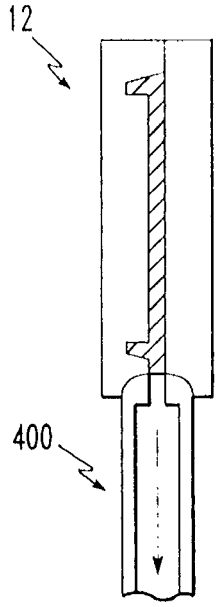
Figure 20F:
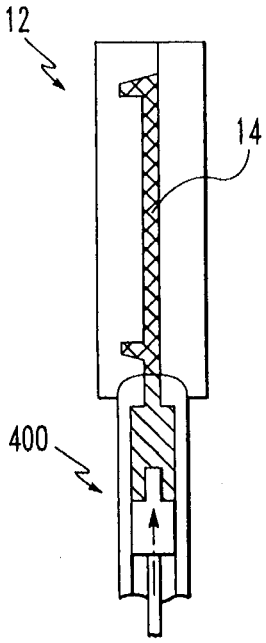
Figure 20G:
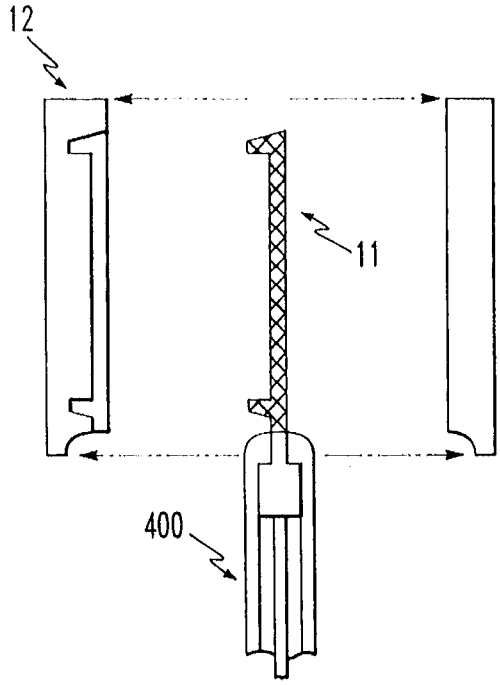

In an alternative embodiment, as shown in FIGS. 20*a*–20*g*, a mold 12 has a single nozzle 400. First, as shown in FIG. 20*c*, the mold 12 is evacuated through the single injection nozzle 400. Next, as shown in FIG. 20*d*, a preform slurry mixture is injected into the cavity 14 through the single injection nozzle 400. Then, as shown in FIG. 20*e*, heat is applied to the mold 12 to cause the removal of the flow agent, and preferably at the same time, the mold 12 is evacuated to facilitate the removal of the burned off flow agent. Then, as shown in FIG. 20*f*, through the single injection nozzle 400, liquid metal is injected into the cavity 14 which has the reinforcement material therein and is infiltrated. Next, the reinforcement material infiltrated with liquid metal is solidified and finally, as shown in FIG. 20*g*, the mold 12 is opened and the formed composite 11 is ejected. It should be noted that the pre-evacuation of the mold 12 and the removal of the flow agent are optional parts of the process. However, air will be pushed out of the mold 12 during the preform mixture injection and flow agent may be driven off during the injection with liquid metal.

The single injection nozzle 400 can be used with many flow agents, binders and reinforcements. For example, wax and silica may be mixed with a ceramic particle such as silicon carbide (SIC) and heated to cause the mixture to flow. Other flow agents can be used including: plastics, thermoset, thermoform, waxes, alcohol and water. Many different binders exist: silica, stearic acid, oxide forming agents, etc. Many reinforcements can be used: metals, ceramics, other organics and organics. The die 12 may be kept at room temperature or temperatures above or below the melting point of the wax to achieve the proper mold filling. Pressures of 10 psi to 100 psi are normally adequate for low velocity flow agents such as Asterwax which can be mixed with 50% SiC and injected at 30 psi at 100° C. Once injected, the nozzle 400 is removed and the die 12 may be heated to drive off the wax. Heating slowly to 300° C. removes the wax and higher temperatures may be used to fuse the SiC particles together with the silica. Only a small amount of silica is required, normally less than ½%. The molds may be metal or ceramic depending on the casting system, temperatures and the reactivity of the material to be cast. Metal is injected following the same procedure as used in Pressure Infiltration Casting, see U.S. Pat. No. 5,111,871, incorporated by reference, squeeze casting or die casting of reinforced composites.

Figure 21A:
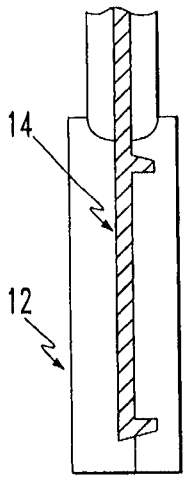
FIGS. 21*a*–21*e* are schematic representations showing the steps of providing a mold having reinforcement and subsequent casting in a casting device.
Figure 21B:
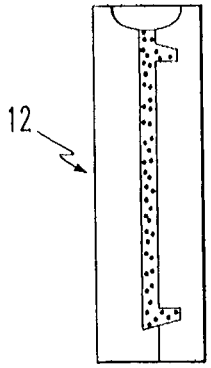
Figure 21C:
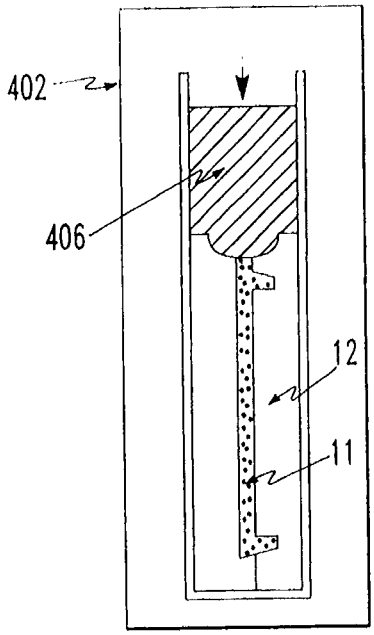

In yet another alternative embodiment, and as shown in FIGS. 21*a*–21*e*, the preform slurry mixture can be injected into the mold 12 and then the mold 12 can be transferred to a casting device. First, as shown in FIG. 21*a*, the preform slurry mixture is injected into the cavity 14. Next, as shown in FIG. 21*b*, the flow agent is removed, creating a mold 12 with just the reinforcement material disposed in the mold 12. Next, as shown in FIG. 21*c*, the mold 12 is transferred to a casting device. For instance, the mold 12 with reinforcement can be placed into a pressure vessel 402, as shown in FIG. 21*c*. The liquid metal can be loaded in a reservoir when the mold 12 is remote from the pressure vessel 402, or after the prepared mold 12 is introduced into the pressure vessel 402, liquid metal can be placed into fluidic communication with the mold 12 such as with a crucible that can pour mold liquid metal into a reservoir in communication with the mold 12, or metal can be placed in a reservoir 406 in communication with the mold 12, as shown in FIG. 21*c*. Then, there is the step of pressurizing the pressure vessel 402 causing the liquid metal to infiltrate into the reinforcement material in the mold 12. Then, after infiltration is completed, the liquid metal is allowed to solidify, the mold 12 is removed from the pressure vessel 402, and the part 11 is extracted from the mold 12.

Figure 21D:
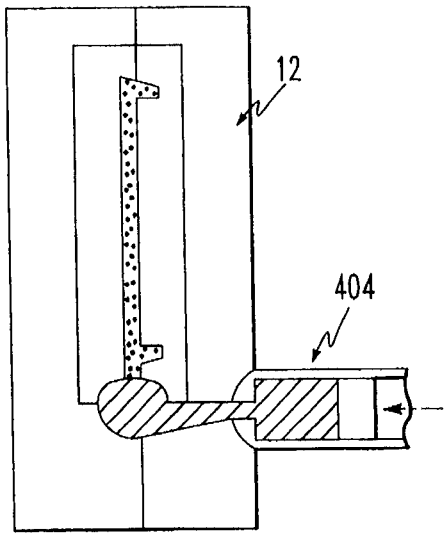

Alternatively, as shown in FIG. 21*d*, the prepared mold 12 can be transferred and connected to an injection device 404.

Figure 21E:
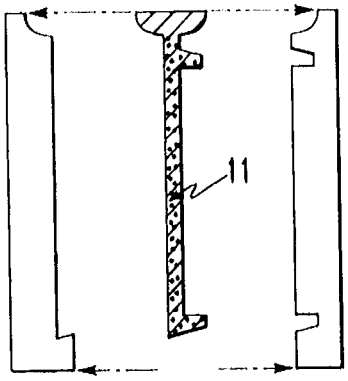
Figure 22A:
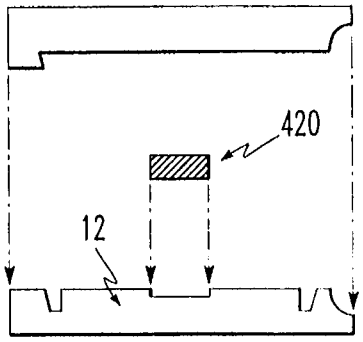
FIGS. 22*a*–22*e* are schematic representations showing the steps of forming a composite article having an insert.
Figure 22B:
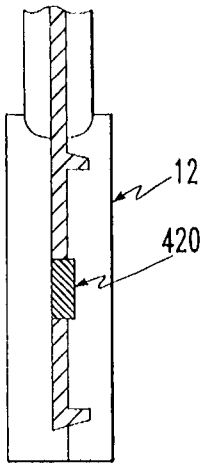
Figure 22C:
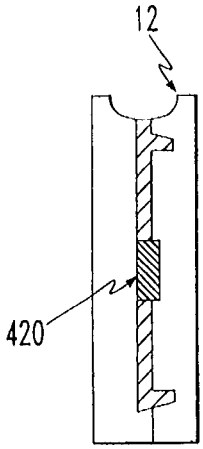
Figure 22D:
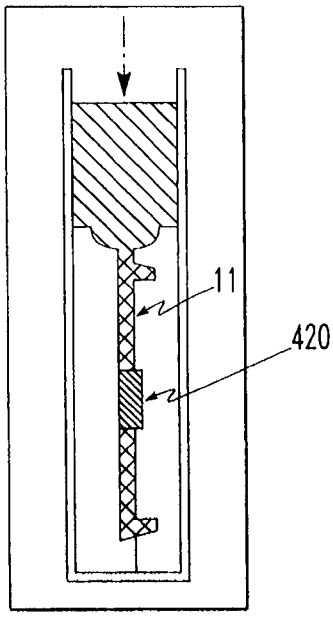
Figure 22E:
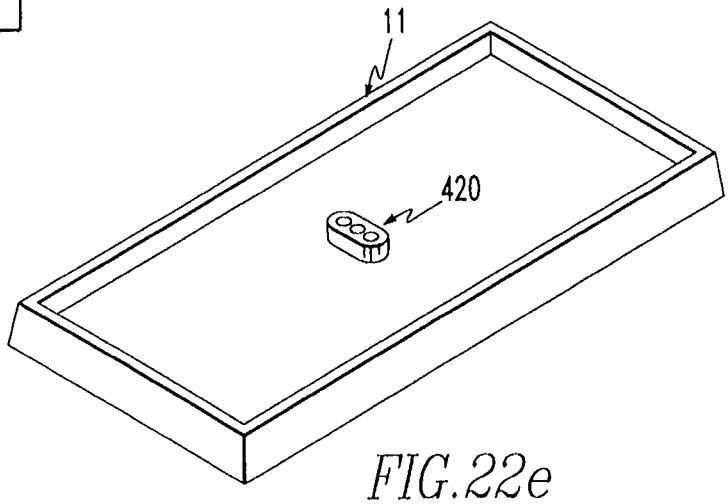
Figure 23A:
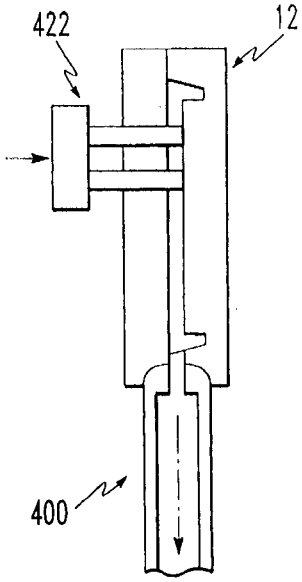
FIGS. 23*a*–23*f* are schematic representations showing the step of casting a composite article having unreinforced areas formed with the aid of retractable core pins of the die.
Figure 23B:
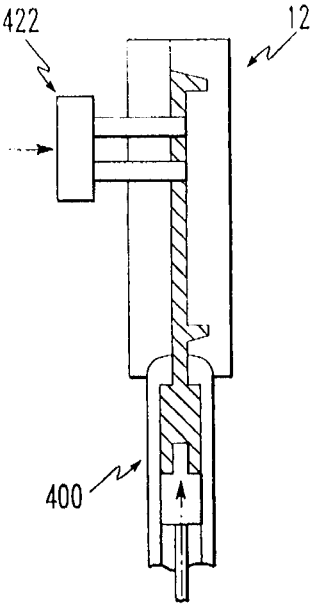
Figure 23C:
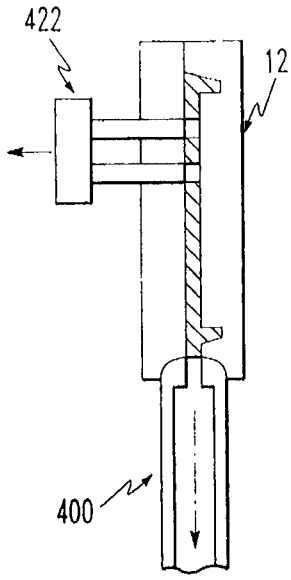
Figure 23D:
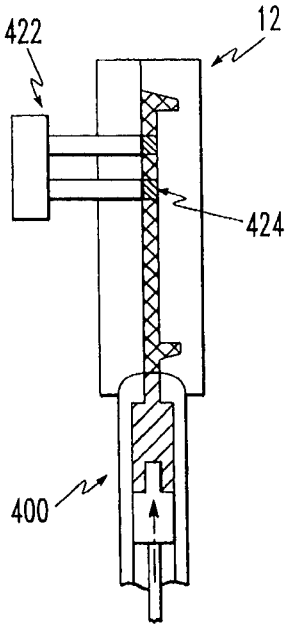
Figure 23E:
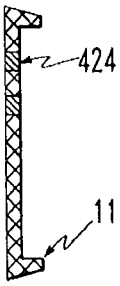
Figure 23F:
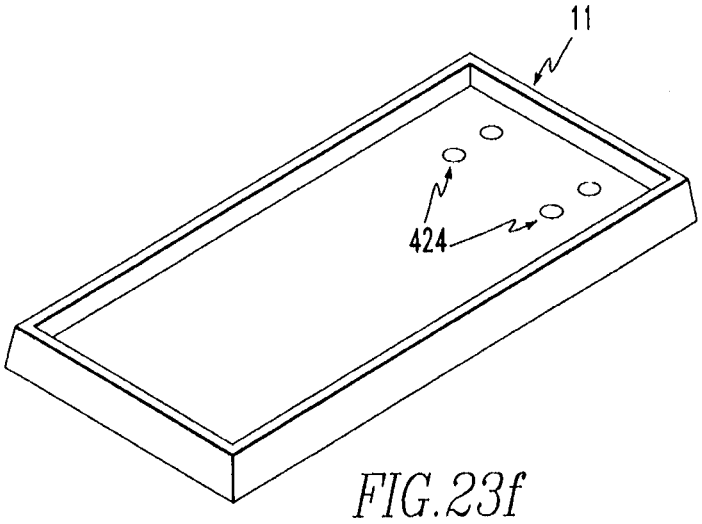

The previously prepared molds, referred to as insert molds, may be constructed of metal or ceramic or a composite. For example, coefficient of thermal expansion (CTE) Matched Mold Materials such as copper/graphite may be injected with a preform mix with wax, water or alcohol used as a flow agent. For example, water may be used along with stearic acid and mixed with a ceramic such as boron carbide. This mixture can then be injected into the mold 12 and the mold 12 can be heated to remove the water or the mold 12 can be loaded directly into a casting machine and heated to remove the water to cause the stearic acid to bind the SiC particles together. Pressure Infiltration Casting or die casting can then be used to infiltrate material into the resulting preform. In Pressure Infiltration Casting, the die 12 may be heated to 650° C. and injected with liquid aluminum. After injection, the insert mold 12 is removed from the casting device and then opened to remove the composite part 11 as shown in FIG. 21*e*.

Figure 26A:
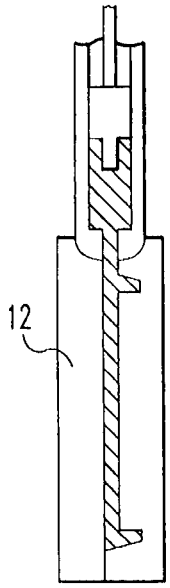
FIGS. 26*a*–26*c* are schematic representations showing a plurality of molds having reinforcement being cast in a common operation.
Figure 26B:
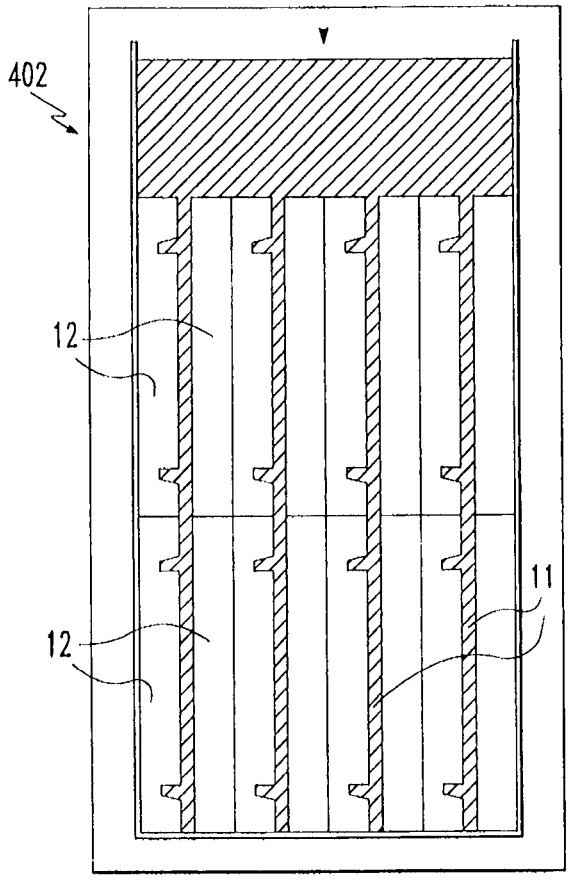
Figure 26C:
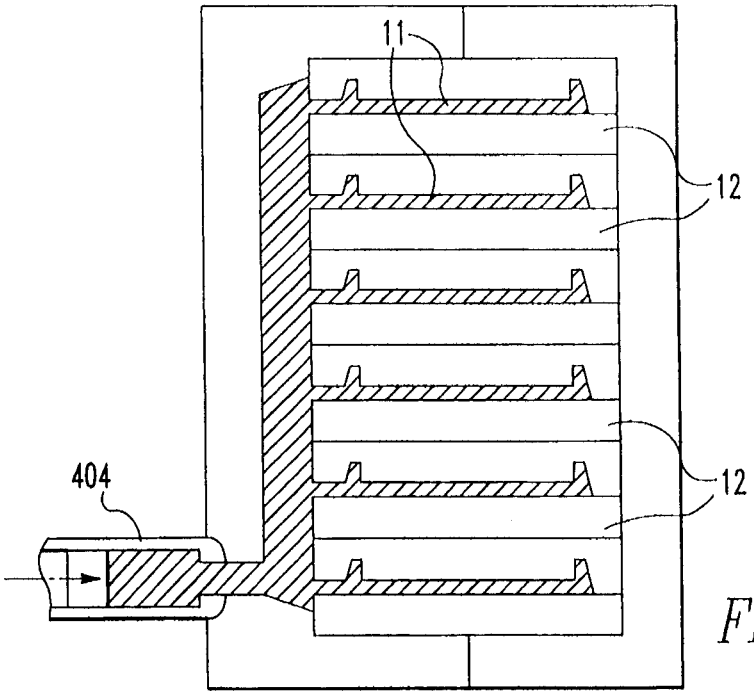

It should be noted, as shown in FIGS. 26*a*–26*c*, that by this method, many molds 12 may be stacked together, such as in a pressure vessel 402 with the molten liquid metal placed in communication with all molds 12, so all of the molds 12 which are stacked together can be infiltrated with the liquid metal. Also, molds 12 by this process can be loaded into a die caster 404 or essentially any type of casting machine with other molds 12 and then infiltrated with liquid metal. This process is extremely valuable to those trying to use a die casting or squeeze casting technique because it removes the need to handle the preform itself. Essentially, the mold 12 injected with the preform slurry is heated to remove the flow medium or binder in a separate furnace and is thus prepared in advance for infiltration. As with all the single die processes described herein, the same mold 12 is used to form the reinforcement and the composite part 11. As with the single die injection nozzle 400 described above, burn out and pre-evacuation are optional steps.

Figure 24A:
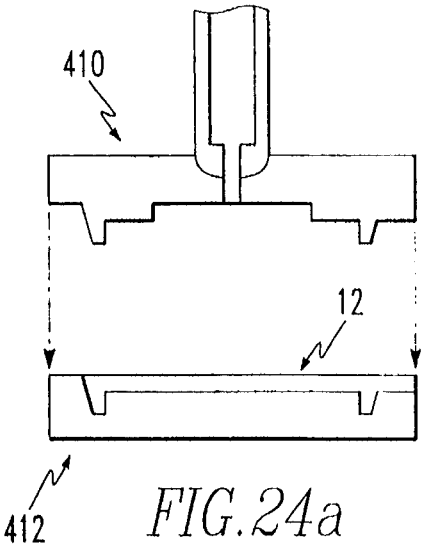
FIGS. 24*a*–24*d* are schematic representations showing the steps of casting a composite article having specific areas of reinforcement using an adapter plate and a pressure vessel.
Figure 24B:
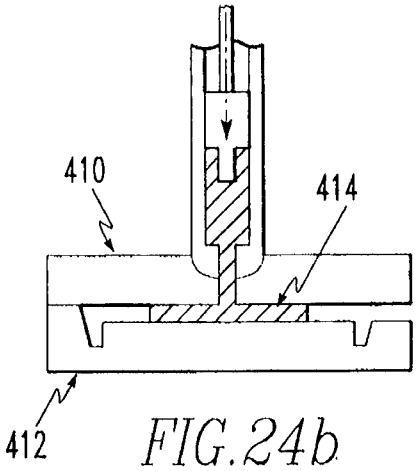
Figure 24C:
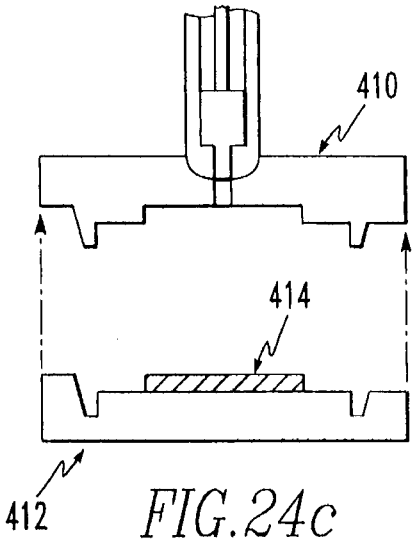
Figure 24D:
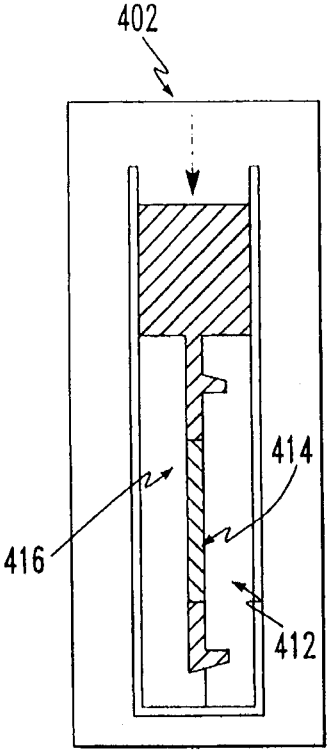
Figure 25A:
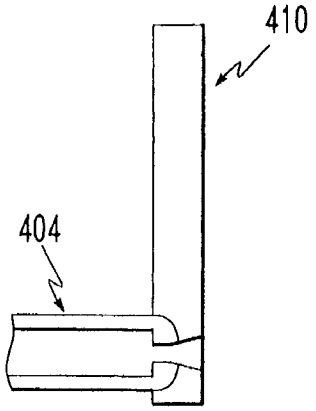
FIGS. 25*a*–25*e* are schematic representations showing the steps of casting a composite article having specific areas of reinforcement using an adapter plate and an injection device.
Figure 25B:
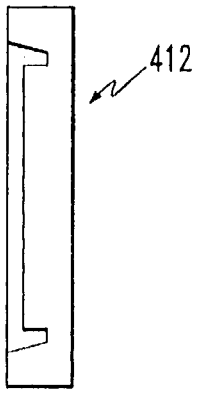
Figure 25C:
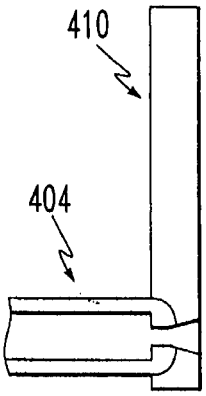
Figure 25D:
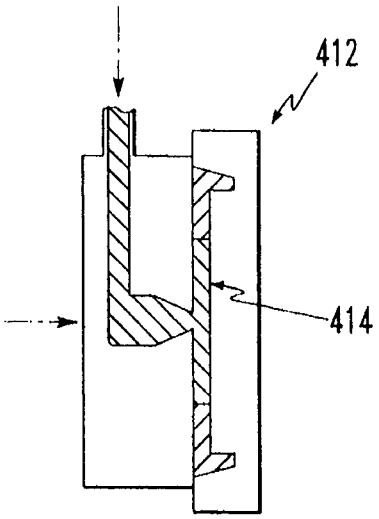
Figure 25E:
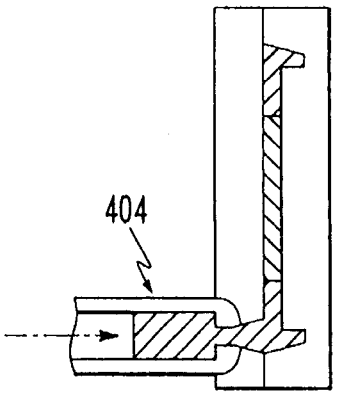

In yet another alternative embodiment, and as shown in FIGS. 24*a*–24*c*, an adapter injection plate 410 can be used to selectively inject preform slurry mixture into different areas of the mold 12, rather than preform slurry mixture being introduced everywhere into the mold 12 as described above, subject to the presence of captured inserts or pins, etc. In this embodiment, an injector plate 410 fits against a first die half 412 such that it forms a reinforcement cavity 414. The adapter injection plate 410 is of a desired shape such that it seals against the first die half 412. The preform of slurry mixture is introduced into the reinforcement cavity 414. When wax is used as the flow agent and binder, it fills the desired portion of the reinforcement cavity 414 extremely quickly where it subsequently solidifies due to cooling effects. The adapter injection plate 410 is then removed and the second die half 416 of the mold 12 is fitted against the first die half 412 and properly sealed so that subsequent infiltration of liquid metal can occur in either a pressure vessel 402, as shown in FIG. 24*d*, or with an injection device 404, as shown in FIG. 25*e*.

When the liquid metal infiltrates into the reinforcement material which remains after the flow agent or binder has been burned away, the infiltration of the liquid metal is such that it flows around and fills up the void that had been selectively formed due to the use of the adapter injector plate 410 rather than essentially pushing the present reinforcement material in the mold 12 into the selectively formed voids. Alternatively, instead of having an injector plate 410 designed for the entire mold, the injector plate 410 can be designed for only portions of the mold 12, and the same injector plate 410 can be then moved sequentially to predetermined areas in the mold 12 to properly create voids and preform material as shown in FIGS. 25*a*–25*e*.

Alternatively, a single die adapter can be designed such that it fits between the mold die halves 412, 416. When the mold die halves 412, 416 are fitted together to form the desired mold chamber to produce the ultimate part, the adapter plate is disposed inside the cavity 414 defined by the two die halves 412, 416 and has a tube extending through a port which communicates with the outside of the mold 12 from the cavity 414. The preform slurry material is introduced into the cavity 414 through the adapter plate. When the preform slurry mixture is introduced to various outlets in the single die adapter to fill the cavity 414 at desired locations as created by where the adapter plate is not, the preform slurry mixture fills the voids in the order of a second where it solidifies to maintain its shape. After injection is complete, the dies halves 412, 416 are then separated, the adapter plate is then removed, and the die halves are once again sealed together where the flow agent of the preform slurry mixture is removed and infiltration with liquid metal of the reinforcement material occurs.

Through the use of more than one injector plate it is possible to inject different preform reinforcing mixtures into different parts of a casting mold 12 so that the resulting part could be reinforced with different systems in selective areas. This combined with the cast in inserts gives complete flexibility to produce a cast component with completely tailorable features in desired locations.

It should be appreciated that inserts of many different materials and geometries can be loaded into the mold 12 to cause desired effects. For example, inserts of high temperature wax or plastic may be inserted into the mold prior to injection of the preform mixture. These inserts block the formation of reinforcement in specific areas and upon heating the inserts will volatize leaving unreinforced areas in the resulting preform. Upon infiltration, these areas are filled with pure metal and can be used for many purposes such as areas for easy machining, for threading and for feed-thru insertion as required in the case of electronic components.

Many other types of inserts 420 can be loaded and formed within the preform. For example, as shown in FIGS. 22*a*–22*e*, electrical feed-thrus and insulators can be loaded into the mold 12 and will result in a reinforced part 11 with cast in feed-thrus 420. Metal parts of other materials can be also be inserted into the mold 12 prior to mixture injection to cause unreinforced areas of a different metal or the same metal as the matrix. These types of inserts 420 are ideal for welding, threading and brazing. For example, an aluminum composite can be cast with Kovar® or stainless steel inserts which allow the aluminum composite part to be welded to other materials. Inserts 420 may be in many forms. For example, the insert 420 may be a hollow radiator system comprised of hollow tubes of stainless steel completely sealed such that they can be loaded into the mold prior to preform injection resulting in a reinforced composite part with an internal radiator or cooling system. Access to the captured system can be accomplished by drilling into the tubes after casting. The radiators can also contain a fluid and act as a totally sealed system such as heat pipes. The inserts 420 can also be leachable materials which can be removed after infiltration. For example, salt or quartz cores may be leached out or copper cores may be etched out.

The inserts, as shown in FIGS. 23*a*–23*f* can also be core pins 422 which protrude and retract through the mold wall. In this manner, areas 424 of pure metal can be formed void of reinforcement.

What is claimed is:

1. A method for producing a metal matrix composite in a single die cavity having a single injection nozzle comprising the steps of:

injecting reinforcement material mixed with a liquid flow agent in the die cavity through the single injection nozzle;

forcing liquid metal through the single injection nozzle into the die cavity such that the metal infiltrates the reinforcement material and the flow agent is removed;

solidifying the liquid metal; and removing the infiltrated composite material from the die cavity.

2. A method as described in claim 1 wherein before the injecting step, there is the step of evacuating the die cavity through the single injection nozzle.

3. A method for producing a metal matrix composite in a single die cavity comprising the steps of:

placing an insert into the die cavity;

injecting reinforcement material mixed with a flow agent into the die cavity;

removing the flow agent such that the reinforcement material remains in the die cavity;

forcing liquid metal into the die cavity such that the metal infiltrates the reinforcement material;

solidifying the liquid metal; and removing the infiltrated composite material from the die cavity.

4. A method as described in claim 3 wherein before the step of forcing liquid metal, there is the step of removing the insert from the die cavity.

5. A method as described in claim 4 wherein the placing step includes the step of moving core pins through a wall defining the die cavity into the die cavity and the removing step includes the step of retracting the core pins from the die cavity through the wall.

6. A method as described in claim 5 wherein before the injecting step, there is the step of coating at least a portion of the die cavity.

7. A method as described in claim 3 wherein the injecting step includes the step of injecting reinforcement material mixed with a liquid flow agent of plastic, thermoset, thermoform, wax, alcohol or water.

8. A method as described in claim 3 wherein the injecting step includes the step of injecting reinforcement material mixed with a liquid flow agent and a binder.

9. A method as described in claim 8 wherein the injecting step includes the step of injecting reinforcement material mixed with a liquid flow agent and a binder of silica, stearic acid or oxide forming agents.

10. A method for producing a metal matrix composite in a single die cavity having a single injection nozzle comprising the steps of:

injecting reinforcement material mixed with a liquid flow agent in the die cavity through the single injection nozzle;

removing the flow agent such that the reinforcement material remains in the die cavity;

forcing liquid metal through the single injection nozzle into the die cavity such that the metal infiltrates the reinforcement material;

solidifying the liquid metal; and removing the infiltrated composite material from the die cavity.

11. A method as described in claim 10 wherein the injecting step includes the step of injecting reinforcement material mixed with a liquid flow agent and a binder.

12. A method as described in claim 11 wherein the injecting step includes the step of injecting reinforcement material mixed with a liquid flow agent and a binder of silica, stearic acid or oxide forming agents.

13. A method as described in claim 10 wherein the injecting step includes the step of injecting reinforcement material mixed with a liquid flow agent of plastic, thermoset, thermoform, wax, alcohol or water.

14. A method for producing a metal matrix composite in a single die cavity having a single injection nozzle comprising the steps of:

injecting reinforcement material mixed with a flow agent in the die cavity through the single injection nozzle;

forcing liquid metal through the single injection nozzle into the die cavity such that the metal infiltrates the reinforcement material and the flow agent is removed;

solidifying the liquid metal; and removing the infiltrated composite material from the die cavity.

15. A method as described in claim 14 wherein the injecting step includes the step of injecting reinforcement material mixed with a liquid flow agent and a binder.

16. A method as described in claim 15 wherein the injecting step includes the step of injecting reinforcement material mixed with a liquid flow agent and a binder of silica, stearic acid or oxide forming agents.

17. A method as described in claim 14 wherein the injecting step includes the step of injecting reinforcement material mixed with a liquid flow agent of plastic, thermoset, thermoform, wax, alcohol or water.

18. A method for producing a metal matrix composite in a single die cavity comprising the steps of:

injecting reinforcement material mixed with a liquid flow agent in the die cavity;

removing the flow agent such that the reinforcement material remains in the die cavity;

moving the die cavity into fluidic communication with a casting device;

forcing liquid metal into the die cavity with the casting device such that the metal infiltrates the reinforcement material;

solidifying the liquid metal; and removing the infiltrated composite material from the die cavity.

19. A method as described in claim 18 wherein the moving step includes the steps of placing the die cavity into a pressure vessel.

20. A method as described in claim 19 wherein the placing step includes the step of placing a plurality of die cavities into a pressure vessel and the forcing step includes the step of pressurizing the pressure vessel such that the die cavities are infiltrated with metal.

21. A method for producing a metal matrix composite within a single die cavity comprising the steps of:

selectively injecting reinforcement material mixed with a liquid flow agent into only specific areas of the die cavity;

removing the flow agent such that the reinforcement material remains in the die cavity;

forcing liquid metal into the die cavity such that the metal surrounds the areas about the reinforcement material and infiltrates the reinforcement material;

solidifying the liquid metal; and removing the infiltrated composite material from the die cavity.

22. A method as described in claim 21 wherein before the injecting step, there is the step of forcing an adapter plate against a first mold half defining the die cavity.

23. A method as described in claim 22 wherein before the forcing step, there are the steps of removing the adapter plate from the first mold half and forcing a second mold half against the first mold half.

24. A method as described in claim 23 wherein before the step of injecting reinforcement material, there is the step of orienting an adapter plate within the die cavity and before the step of forcing liquid metal, there is the step of removing the adapter plate from the die cavity.

25. A method for producing a metal matrix composite in a single die cavity having a single injection nozzle comprising the steps of:

injecting reinforcement material mixed with a flow agent in the die cavity through the single injection nozzle;

removing the flow agent such that the reinforcement material remains in the die cavity;

forcing liquid metal through the single injection nozzle into the die cavity such that the metal infiltrates the reinforcement material;

solidifying the liquid metal; and removing the infiltrated composite material from the die cavity.

26. A method as described in claim 25 wherein the injecting step includes the step of injecting reinforcement material mixed with a liquid flow agent of plastic, thermoset, thermoform, wax, alcohol or water.

27. A method as described in claim 25 wherein the injecting step includes the step of injecting reinforcement material mixed with a liquid flow agent and a binder.

28. A method as described in claim 27 wherein the injecting step includes the step of injecting reinforcement material mixed with a liquid flow agent and a binder of silica, stearic acid or oxide forming agents.

* * * * *